United States Patent [19]

Clayburn

[11] Patent Number: 4,865,286

[45] Date of Patent: Sep. 12, 1989

[54] PRINTOUT SUPPORT

[75] Inventor: C. Wayne Clayburn, Cincinnati, Ohio

[73] Assignee: Hunt Holdings, Inc., Wilmington, Del.

[21] Appl. No.: 205,815

[22] Filed: Jun. 13, 1988

[51] Int. Cl.[4] ..... A47B 97/08

[52] U.S. Cl. ..... 248/460

[58] Field of Search ..... 248/441.1, 448, 449, 248/450, 451, 452, 453, 459, 460, 462, 174; 40/359; 281/33

[56] References Cited

U.S. PATENT DOCUMENTS

| | | | |
|---|---|---|---|
| 1,635,420 | 7/1927 | Johnson | 281/33 |
| 1,752,017 | 3/1930 | Metzger | 248/459 |
| 1,923,351 | 8/1933 | Woodley . | |
| 2,331,595 | 10/1943 | Bush . | |
| 2,490,356 | 12/1949 | Hummel | 248/452 |
| 2,802,295 | 8/1957 | Kraus | 248/453 |
| 2,982,568 | 5/1961 | Wolfe | 281/33 |
| 3,305,206 | 2/1967 | Nichols | 248/459 |
| 3,370,368 | 2/1968 | Paschal | 248/459 |
| 3,376,009 | 4/1968 | Domino . | |
| 3,380,701 | 4/1968 | Byars | 248/459 |
| 4,369,948 | 1/1983 | Krauss . | |
| 4,508,306 | 4/1985 | Kemmerer . | |
| 4,544,123 | 10/1985 | Peacock | 248/462 |
| 4,709,895 | 12/1987 | Mardak | 248/460 |

FOREIGN PATENT DOCUMENTS

| | | | |
|---|---|---|---|
| 950434 | 7/1974 | Canada | 248/459 |
| 1566394 | 3/1969 | France | 40/359 |
| 2579931 | 10/1986 | France | 40/359 |

*Primary Examiner*—Alvin C. Chin-Shue
*Assistant Examiner*—Robert A. Olson
*Attorney, Agent, or Firm*—Alexis Barron; Albert L. Free

[57] ABSTRACT

A stand for supporting a packet of fanned computer printout sheets which enables easy leafing forwardly and backwardly through the packet. A rear backer plate is provided with a forwardly and upwardly extending bottom ledge designed to hold the packet in a positionally-stable upright position, and a lower substantially horizontal plate with associated ledge supports those sheets which are turned down in the packet. The rear backing plate and the lower substantially horizontal backer plate are preferably hinged to each other to permit folding-up of the entire support into a compact configuration, and the ledge for the horizontal plate is preferably hinged so it can be swung upwardly and inwardly of the horizontal plate for use with packets of sheets of lesser height. An integral horizontal rear flange limits the rearward tilt of the rear backer plate to the desired angle.

1 Claim, 4 Drawing Sheets

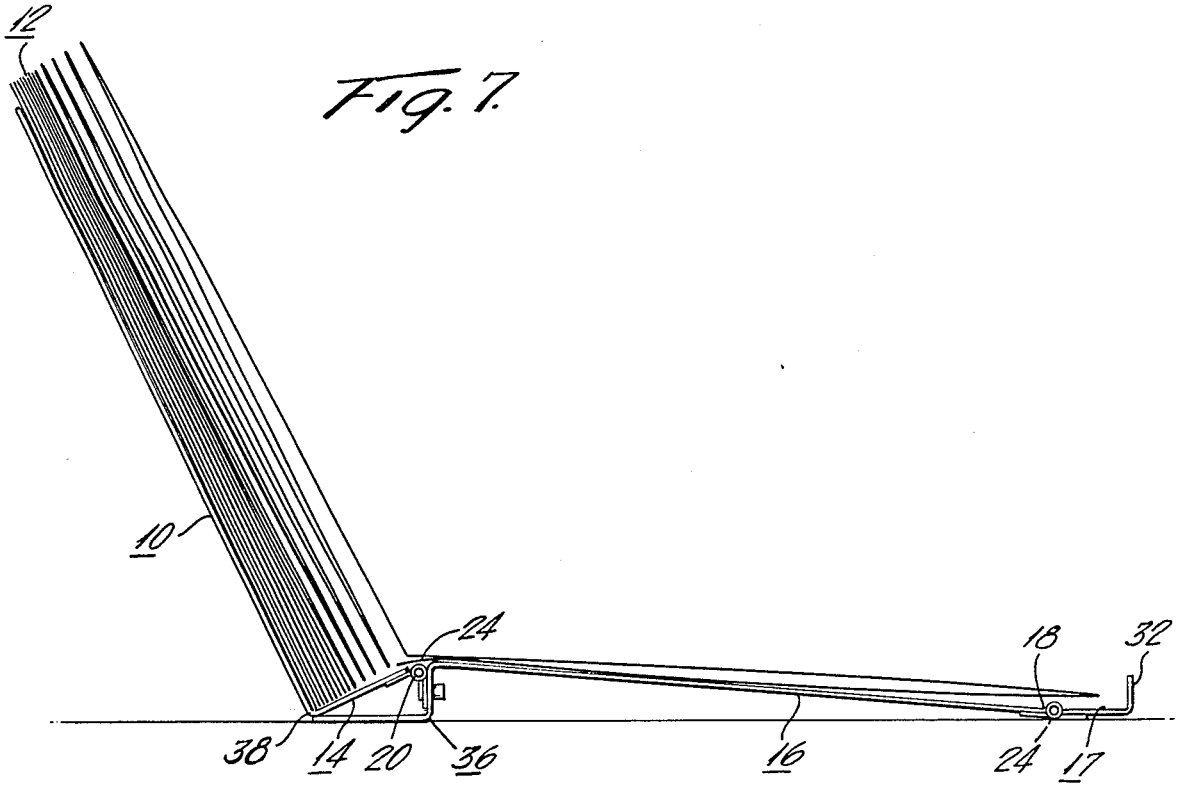
Fig. 7.
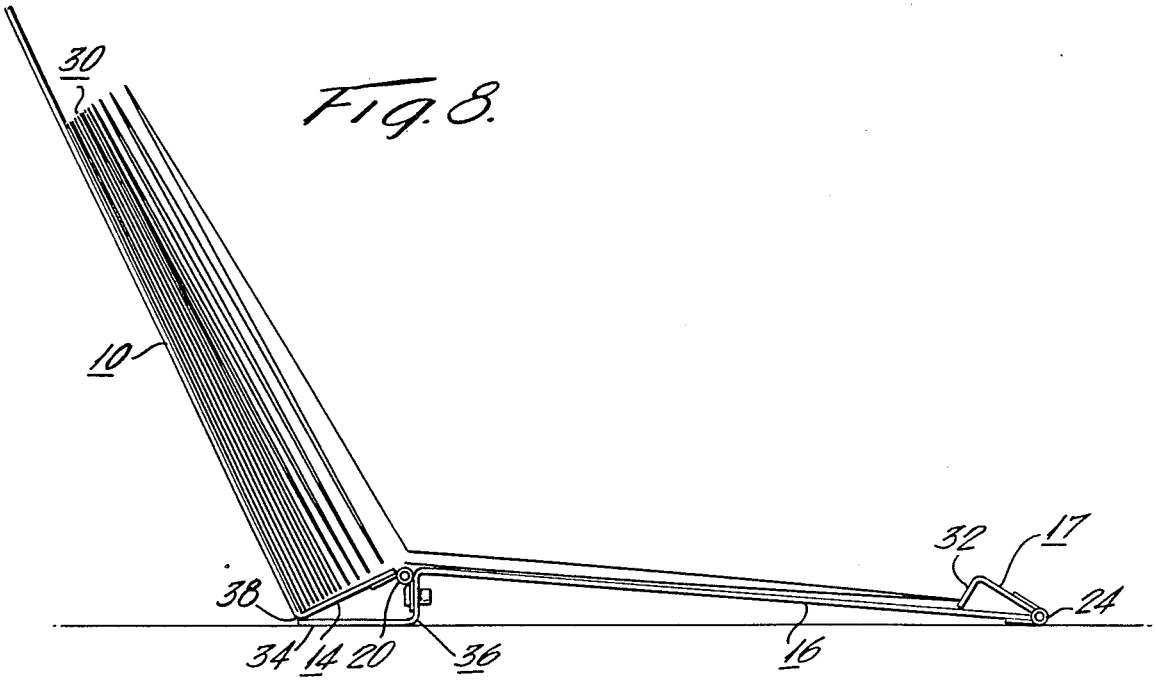
Fig. 8.
Fig. 9.
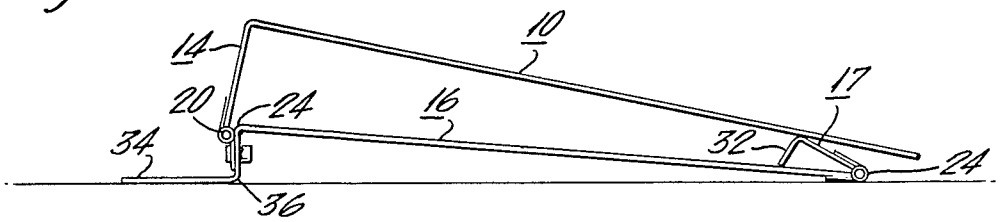

PRINTOUT SUPPORT

BACKGROUND OF THE INVENTION

This invention relates to apparatus for supporting a packet of computer print-out sheets for easy viewing, especially so that any selected individual sheet in the packet can readily be presented to view in a generally upright position.

In reviewing information presented in a packet of computer printout sheets, it is often desirable to turn to and to observe one or more selected individual sheets. This is often true, for example, when the individual sheets are parts of a continuous fanned strip of computer print-out paper.

Simple document-support stands are known which comprise a flat backing member held in an upwardly-extending oblique position with a forwardly-extending ledge along its bottom edge for holding one or more documents for reading or leafing through. If such a stand were used to support a picket of fanned printout sheets, and if one desired to observe selected pages in a packet so-supported, it would be necessary either to hold in a forward position those sheets preceeding the selected one, or to remove and refold the packet so that the selected sheet is on top. Such operations clearly are awkward and time-wasting.

It is also possible to provide a stand consisting of an angled strip of sheet metal bent so that a rear portion thereof extends obliquely upwardly and so that a forward portion thereof extends forwardly and horizontally, with a restraining ledge provided along the forward edge of the horizontal portion to limit forward motion of sheets on the horizontal plate. The packet of fanned printout sheets could then be placed initially against either the oblique or the horizontal portion of the angled plate, and the sheets turned so as to be transferred from one or to the other of the angled plate portions. However, it has been found that if this is done, the packet is positionally unstable when placed against the oblique plate portion, for example tending either to topple forwardly or to slip at its bottom edge and slump toward a horizontal position. Also, when turning sheets from a horizontal position into the obliquely upright position although a few may initially stay in place, after a few or perhaps twenty sheets have thus been turned the obliquely-upright stack generally also becomes positionally unstable.

A general object of the present invention is to provide an improved print-out support which enables easy manual selection and reliable support of those sheets of the packet which one wishes to view, and easy leafing-through of a packet of such sheets, either from front to back or from back to front, without encountering positional instability of the sheets.

Another object is to provide such a print-out support which is readily adjusted to accommodate packets of print-out sheets of different heights.

A further object is to provide such a printout support which can be folded into a compact configuration when not in use.

BRIEF SUMMARY OF THE INVENTION

These and other objects of the invention are achieved by the provision of a novel support for supporting a packet of print-out sheets, comprising a first sheet-supporting member extending obliquely upwardly for supporting the back side of the packet of sheets, a first ledge extending forwardly and upwardly from the lower edge of said first sheet-supporting member for preventing sheets of said packet from sliding downwardly when placed against said first sheet-supporting member, a second sheet-supporting member extending forwardly and generally horizontally from the edge of said first ledge for supporting the front side of a packet placed over it, and a second ledge extending along the edge of said second sheet-supporting member remote from said first edge, for preventing said sheets of said packet lying on said second sheet-supporting member from sliding beyond the position of said second ledge. With this construction, sheets on the first sheet-supporting member and on the first ledge maintain themselves in stable upright position, as desired.

In a preferred embodiment, first hinge means are operatively secured between said first and second sheet-supporting members so that said print-out support may be folded up into a compact configuration. In addition, in a preferred embodiment means are provided for adjusting the position of said second ledge to accommodate different heights of print-out sheets, preferably by providing second hinge means acting between said second ledge and said second sheet-supporting member, these second hinge means permitting said second ledge to be swung between an extended position for accommodating relatively larger sheets and a folded-back position for accommodating relatively smaller sheets. Stop means in the form of a horizontal rearwardly-extending flange are preferably also provided for limiting and stabilizing the angular position of said first sheet-supporting member during its use.

BRIEF DESCRIPTION OF FIGURES

These and other objects and features of the invention will be more readily understood from a consideration of the following detailed description, taken with the accompanying drawings showing the presently-preferred embodiment of the invention, and in which:

FIG. 7 is a side view showing the swingable ledge in its unfolded position and with a packet of relatively tall computer print-out sheets on the support;

FIG. 8 is a side view showing the swingable ledge in its folded position, with a packet of relatively short computer printout sheets on the support; and FIG. 9 is a side view showing the whole support in its folded configuration.

DETAILED DESCRIPTION OF SPECIFIC EMBODIMENTS

Figure 1:
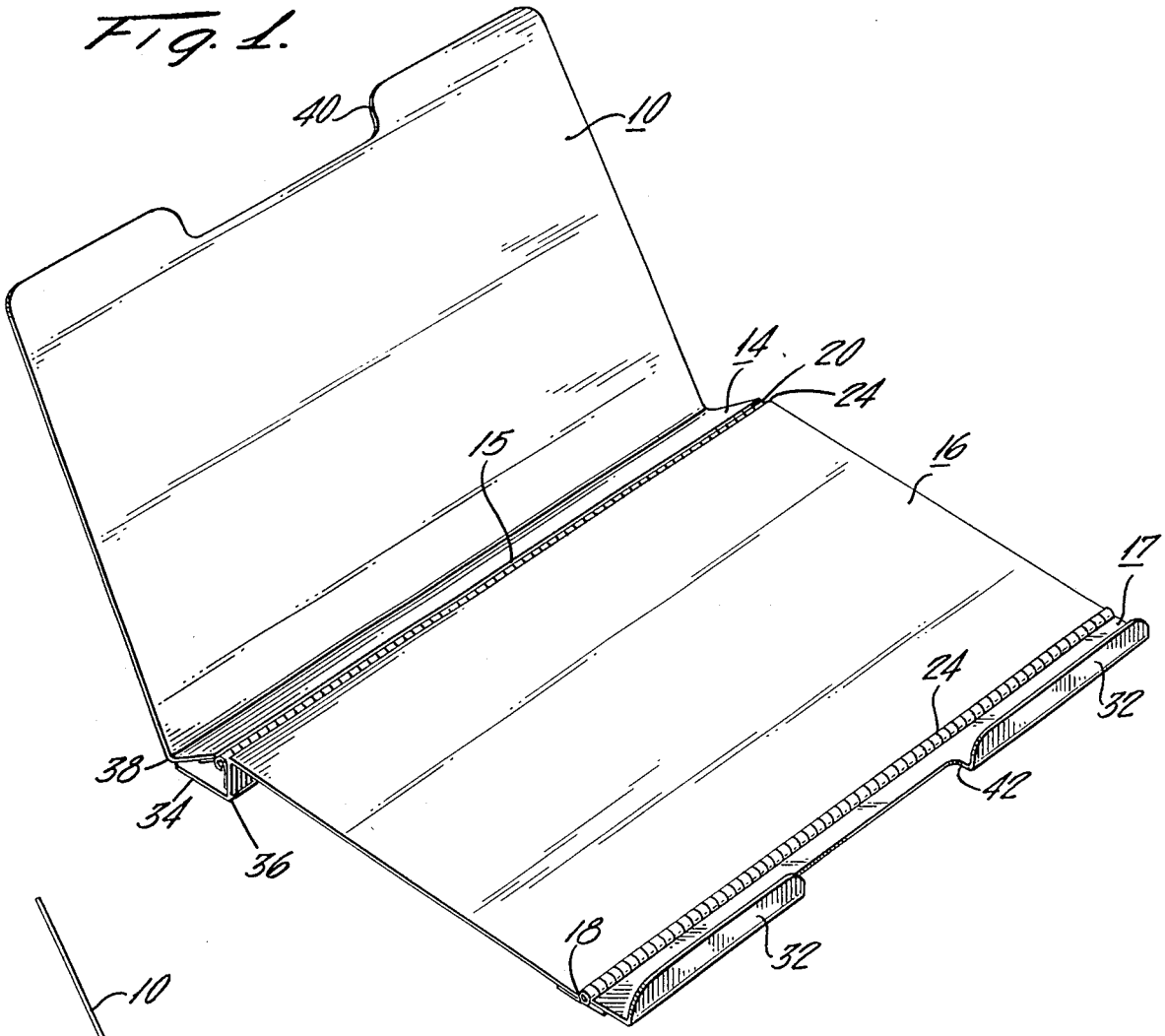
FIG. 1 is a perspective view of the support of the invention with the adjustable ledge extended.

Turning now to the description of specific embodiments shown in the drawings by way of example only, and without thereby in any way limiting the scope of the invention a first sheet-supporting member 10 extends obliquely upwardly from the horizontal to serve as a support for the backside of a packet of sheets such as 12 (FIG. 7). A first ledge 14 extends forwardly and upwardly from the lower end of the first sheet-supporting member 10, to hold securely in position the lower edge of the packet of sheets when they are lying against the sheet-supporting member 10.

A second sheet-supporting member 16 extends forwardly and generally horizontally from the outer edge 15 of first ledge 14, for supporting sheets from the front side of the packet, as indicated in FIG. 7. A second ledge 17 extends along that edge 18 of the second sheet-supporting member 16 which is remote from the first ledge 14 of the first sheet-supporting member 10, for preventing sheets of a packet lying on the second sheet-supporting member from sliding beyond the position of the second ledge.

In order to make the support foldable into a compact assembly, first hinge means 20 operatively connect together the first and second sheet-supporting members; in this example, the hinge is between the free edge 15 of the first ledge 14 and the adjacent edge 24 of the second sheet-supporting member, and is arranged so that the two sheet-supporting members may be pivoted toward each other, with or without a packet of sheets between them, to form a compact assembly convenient for easy carrying, as shown in FIG. 9.

Figure 2:
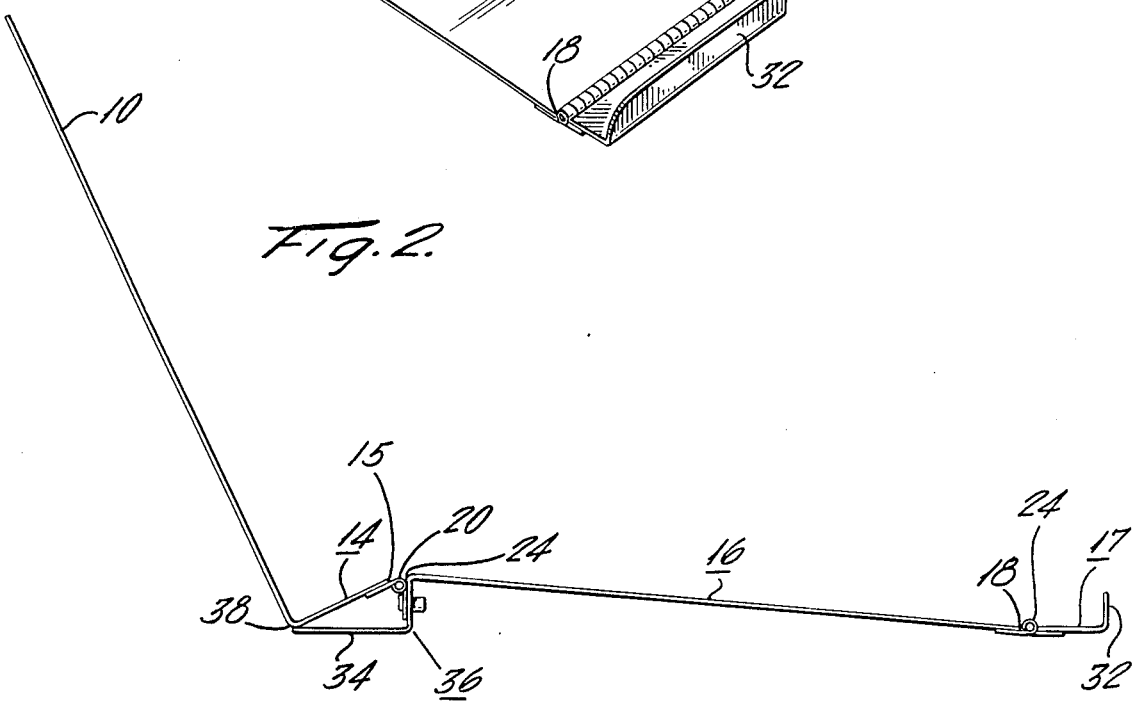
FIG. 2 is a side view of the support.
Figure 4:
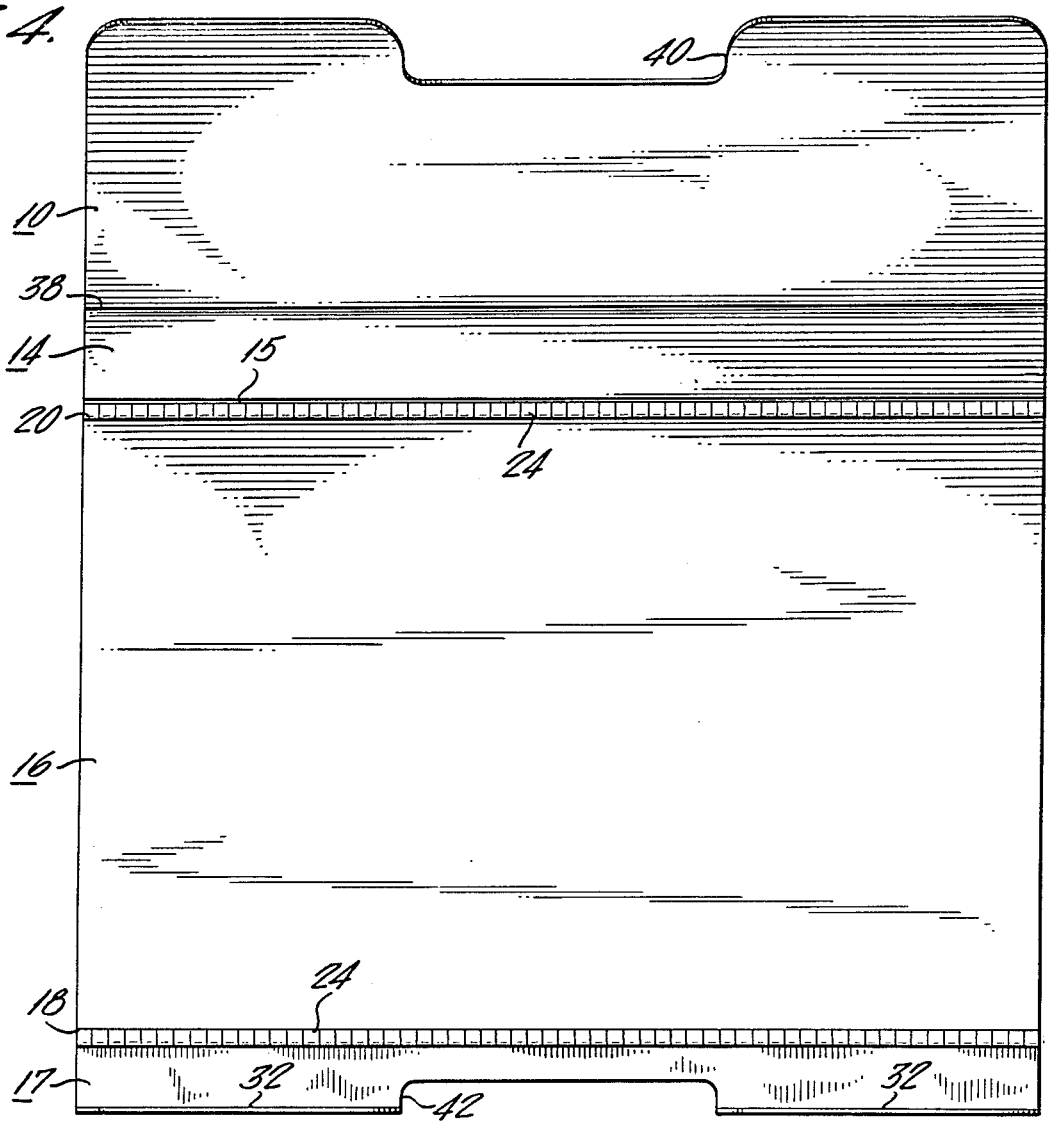
FIG. 4 is a top view of the support.
Figure 3:
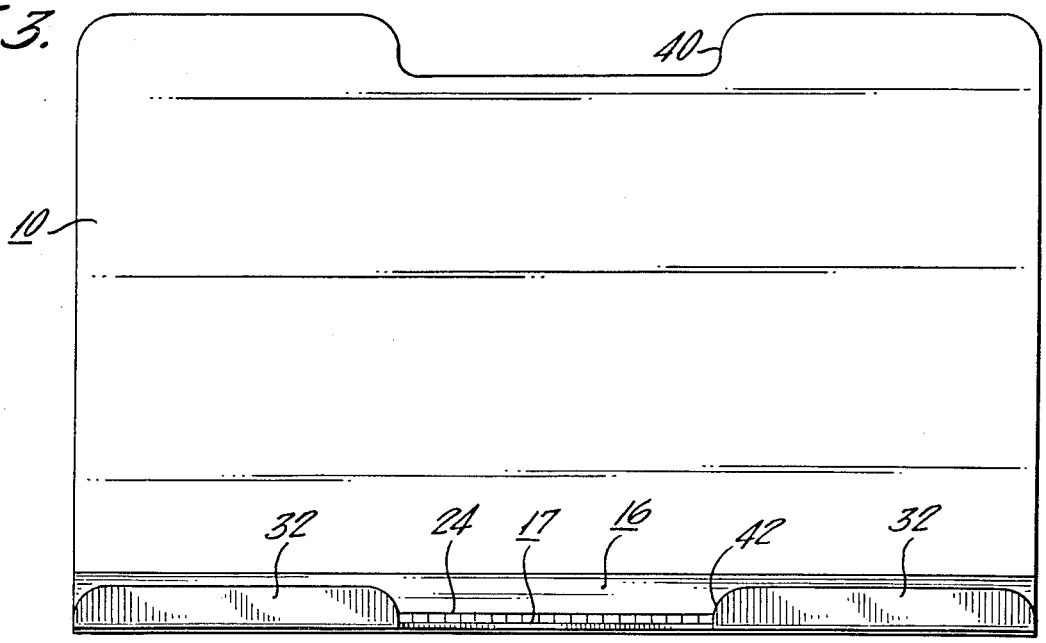
FIG. 3 is a front view of the support.
Figure 5:
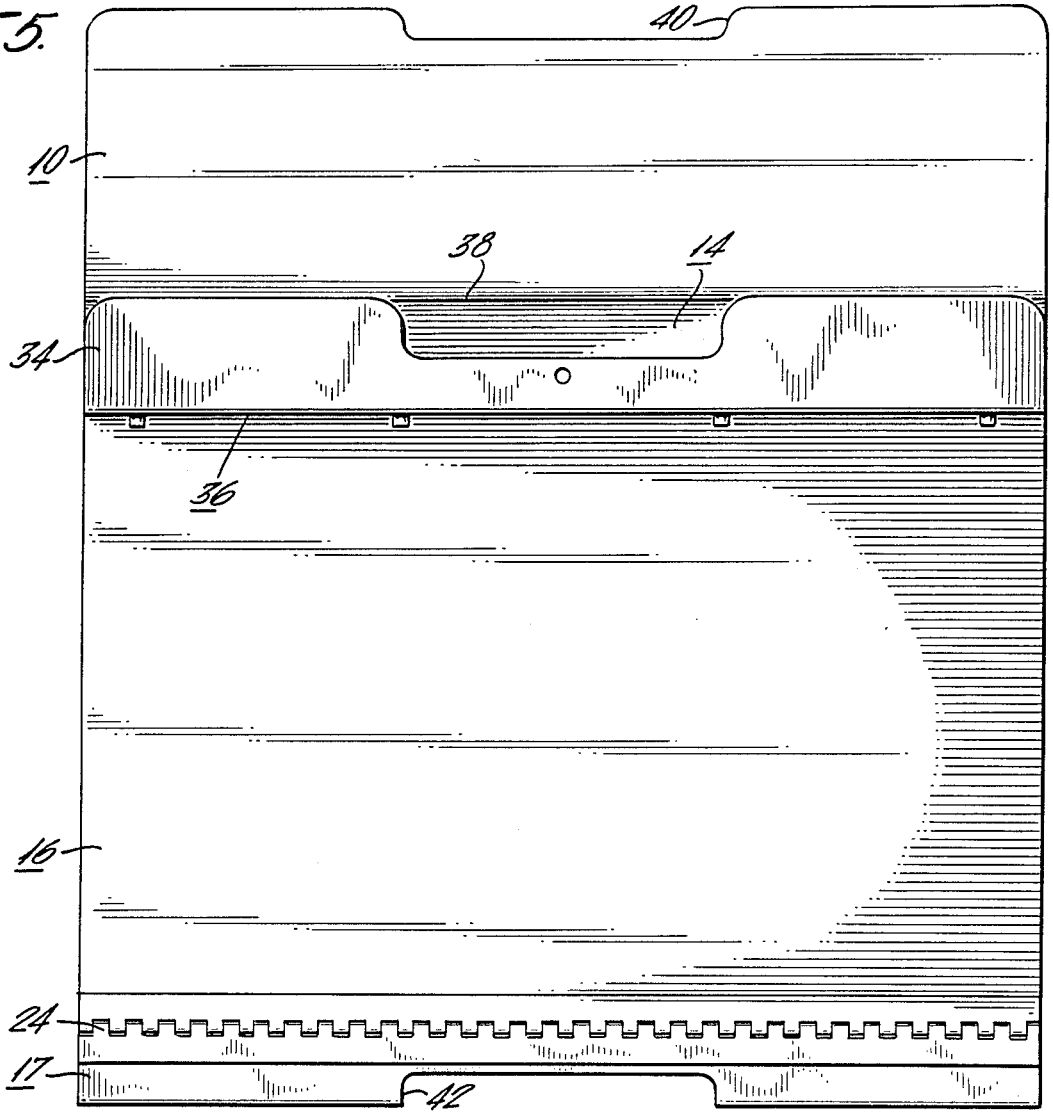
FIG. 5 is a bottom view of the support.
Figure 6:
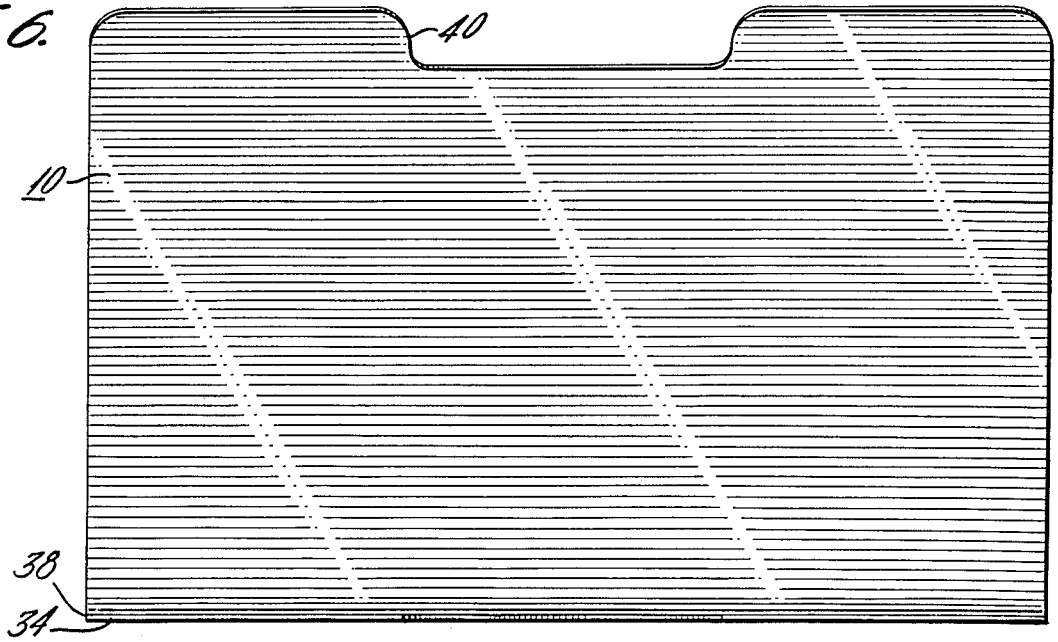
FIG. 6 is a rear view of the support of FIG. 1.

Also in this preferred embodiment the ledge 17 is L-shaped in cross-section and is adjustable in position so as to accommodate print-out sheets of different heights. There are two popular heights of print-out paper at present, namely 812 inches and 11 inches. The outwardly-extended or unfolded position of the ledge 17 shown in FIGS. 1 and 2 accommodates the sheets of larger height, as shown in FIG. 7. Ledge 17 is secured to the second sheet-supporting member 16 by the second hinge means 24, which permits the ledge 17 to be pivoted upwardly to the folded-up position shown in FIG. 8, wherein the lower ends of the sheets of lesser height in the packet 30 may rest against the flange 32 of ledge member 17, as also shown in FIG. 8.

To provide stability for the assembly when in use, means are preferably provided for limiting and stabilizing the angular position of the first sheet-supporting member 10 when in use. In this example, this takes the form of the flange 34 on a right-angle channel member 36, formed along the rear side of the second sheet-supporting member 16, the flange 34 extending rearwardly sufficiently to be contacted by the lower edge or corner 38 of the first sheet-supporting member so that the latter cannot pivot further in the downward direction, and is fixed in the oblique, backwardly-sloping position shown.

While other types of supports for the first sheet-supporting member 10 may be employed, in the presently preferred embodiment the type of support just described is particularly advantageous when made integrally with the second sheet-supporting member by means of two simple right-angle bends formed at the upper end of the second sheet-supporting member 16 prior to securing the hinge means in place, which may be accomplished by bolting and/or rivetting as examples. Other arrangements for providing an adjustable position of the second ledge means 17 may also be used but the hinged arrangement shown is particularly reliable and effective, and easy to use and make.

It is also possible to place the first hinge means 20 at the lower edge or corner 38 of the first sheet-supporting member 10 rather than where shown, with the two sheet-supporting members then being relatively pivotable in the opposite direction from that provided by the embodiment shown. However, in such an arrangement the packet of sheets is not encompassed between the two sheet-supporting members in the folded position of the system, and hence does not provide the advantageous feature that the support may be folded with the packet in it and transported to another place in that fashion. Also, with such an arrangement, a different form of back support for number 40 will usually be used, such as a conventional foldable rear strut, for example.

First sheet-supporting member 10 and flange 32 are preferably provided, respectively, with finger cut-outs 40 and 42 extending along a part of their distal edges remote from the hinge means 20 to enable the user easily to seize and turn the sheets supported on the apparatus.

In use, a packet 12 of computer print-out sheets in the form of a single continuous fanned strip may be initially placed either on the first ledge member 14 of the first sheet-supporting member 10, or on the second sheet-supporting member 16 just rearwardly of the second ledge member 17. From either of these positions successive pairs of folded sheets may be readily turned or pivoted from one support member to the other, so as to enable leafing through the packet in either direction. preferably the folded edges of the sheets of such a packet are positioned upwardly when on the first-supporting member 10, with the material oriented so that it can readily be read while thus lying against the obliquely upwardly-extending supporting member 10.

The support of the invention provides for easy reading of the page selected for viewing, requires little space, accommodates different heights of print-out paper, can readily be folded into a compact configuration (if desired with the packet of print-out sheets within it), and can be manufactured easily and inexpensively. At the same time, it provides a high degree of positional stability of the packet sheets, whether all of them are lying against the obliquely-extending first sheet-supporting member, all are lying against the substantially horizontal second sheet supporting member, or some are in each position.

While the invention has been described with particular reference to specific embodiments in the interest of complete definiteness it will be understood that it can be embodied in a variety of forms diverse from those specifically shown and described, without departing from the spirit and scope of the invention as set forth in the appended claims.

I claim:

1. Apparatus for supporting a packet of sheets of computer print-out paper, said apparatus comprising:

a first sheet-supporting portion for holding sheets of said packet in an upwardly-extending position;

a second sheet-supporting portion secured to and extending forwardly and substantially horizontally from the lower end of said first sheet-supporting portion for holding sheets of said packet in a substantially horizontal position in front of said first sheet-supporting means;

said first sheet-supporting portion comprising an upwardly-extending first backing member adapted to receive and support one side of said packet and first ledge means extending forwardly and upwardly from said first sheet-supporting member along the lower edge of said first backing member for supporting the lower ends of sheets in said packet on said first backing member;

said second sheet-supporting portion comprising a substantially horizontal second backing member for receiving and supporting the other side of said packet, and second ledge means extending along and upwardly from the forward edge of said second sheet-supporting means for limiting forward motion of said packet when on said second backing member;

said second backing member being of sufficient height between said first ledge means and said second ledge means to accommodate therebetween a sheet of said packet;

hinge means hingedly interconnecting said first ledge and said second backing member so that they may be rotated one with respect to the other to collapse said apparatus into a compact configuration for storage and/or carrying;

whereby said packet may be placed on either of said first and second backing member and the sheets thereof turned to rest on the other of said first and second backing members; and means for limiting the pivotal motion of said first backing member about said hinge means in the direction to tilt said first backing member backwards away from said second backing member;

wherein said limiting means comprises a right-angle channel member formed integrally with said second backing member at the edge thereof to which said first hinge means is secured, said channel member having a substantially flat, horizontal flange portion extending rearwardly from said first hinge means sufficiently to extend beneath the lower end of said first backing member.

* * * * *